US011469062B1

(12) United States Patent
Hendrix

(10) Patent No.: US 11,469,062 B1
(45) **Date of Patent: *Oct. 11, 2022**

(54) POWER OUTAGE ISOLATION DEVICE

(71) Applicant: Robert Neal Hendrix, Florence, AL (US)

(72) Inventor: Robert Neal Hendrix, Florence, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/079,769

(22) Filed: Oct. 26, 2020

Related U.S. Application Data

(63) Continuation of application No. 16/554,747, filed on Aug. 29, 2019, now Pat. No. 10,818,452.

(60) Provisional application No. 62/724,686, filed on Aug. 30, 2018.

(51) Int. Cl.
*H01H 33/12* (2006.01)

(52) U.S. Cl.
CPC ..... *H01H 33/121* (2013.01)

(58) Field of Classification Search
CPC ..... H01H 33/121–123; H01H 33/125–128; H01H 33/6661; H01H 33/045; H01H 33/10
USPC ..... 218/2–4, 8, 121, 125, 126, 12; 200/15, 200/48 KB, 48 P, 48 V; 337/155
See application file for complete search history.

(56) References Cited

U.S. PATENT DOCUMENTS 2,399,485 A * 4/1946 Harlow ..... H01H 33/121 218/57
2,632,074 A * 3/1953 Herman ..... H01H 9/36 218/151
2,808,489 A * 10/1957 Maass ..... H01H 33/121 218/12
3,377,447 A * 4/1968 Hermann ..... H01H 31/125 337/156
4,139,747 A * 2/1979 Kelly ..... H01H 33/02 200/237
4,362,915 A * 12/1982 Swindler ..... H01H 33/08 218/149

* cited by examiner

*Primary Examiner* — William A Bolton
(74) *Attorney, Agent, or Firm* — Angela Holt; Bradley Arant Boult Cummings LLP

(57) ABSTRACT

This disclosure relates generally to power isolation switch devices. In one embodiment, a power isolation switch device has a power insulator, an arc breaker, and a switch. The power insulator and the switch are connected in parallel. The arc contact is operably associated with the switch such that the arc contact is removed from the arc chute as the switch is opened and is inserted to contact the arc chute when the switch is closed. In this manner, the power isolation switch device does not need an interrupter and can be provided so as to be less bulky.

8 Claims, 7 Drawing Sheets

POWER OUTAGE ISOLATION DEVICE

RELATED APPLICATIONS

This application is a continuation of U.S. patent application Ser. No. 16/554,747, titled "Power Outage Isolation Device" and filed on Aug. 29, 2019, which claims the benefit of provisional patent application Ser. No. 62/724,686, filed Aug. 30, 2018. The disclosures of both applications are incorporated by reference in their entireties.

FIELD OF THE DISCLOSURE

This disclosure relates generally to components for 3-phase power systems.

BACKGROUND

A portable switch device for disconnecting three phase utility lines provides a low-cost option for interrupting power if repairs are needed or if a car accident requires that power be cut off. Unfortunately, known power switch devices are not compact and portable. Often these switches require interrupters to break an electric arc, which adds a significant amount of weight and bulk to the switch device. Furthermore, the arms of the switch device are often oriented in the horizontal direction thus requiring 6 power insulators to properly isolate the arms of the switch. If one of these six insulators loses dielectric strength, the entire circuit will not operate correctly.

Thus, what is needed are new switch devices that are less bulky and require less power insulators to operate appropriately.

SUMMARY

This disclosure relates generally to power isolation switch devices. In one embodiment, a power isolation switch device has a power insulator, an arc breaker, and a switch. The power insulator and the switch are connected in parallel. The arc contact is operably associated with the switch such that the arc contact is removed from the arc chute as the switch is opened and is inserted to contact the arc chute when the switch is closed. In this manner, the power isolation switch device does not need an interrupter and can be provided so as to be less bulky.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

This disclosure relates generally to power isolation switch devices and in particular to 3-phase power isolation switch devices for utility power lines. Embodiments of a 3-phase power isolation device are disclosed that includes a power insulator for each phase of the utility line and a switch connected in parallel with the power insulator. This allows for the switch and the power insulator to have a vertical orientation with respect to ground and thus multiple power insulators are not required for each phase of utility power lines. An arc breaker with an arc chute is attached to one of the terminals of the switch. The arc contact (e.g., conductive arc blade) of the arc breaker is operated by opening and closing the switch. This allows for the 3-phase power isolation switch device to operate without an interrupter. Furthermore, a tie bar with a horizontal orientation can be attached to all three switches to operate each phase of the 3-phase power isolation switch device. Accordingly, embodiments of the 3-phase power isolation switch device are less bulky and easy to transport.

Figure 1:
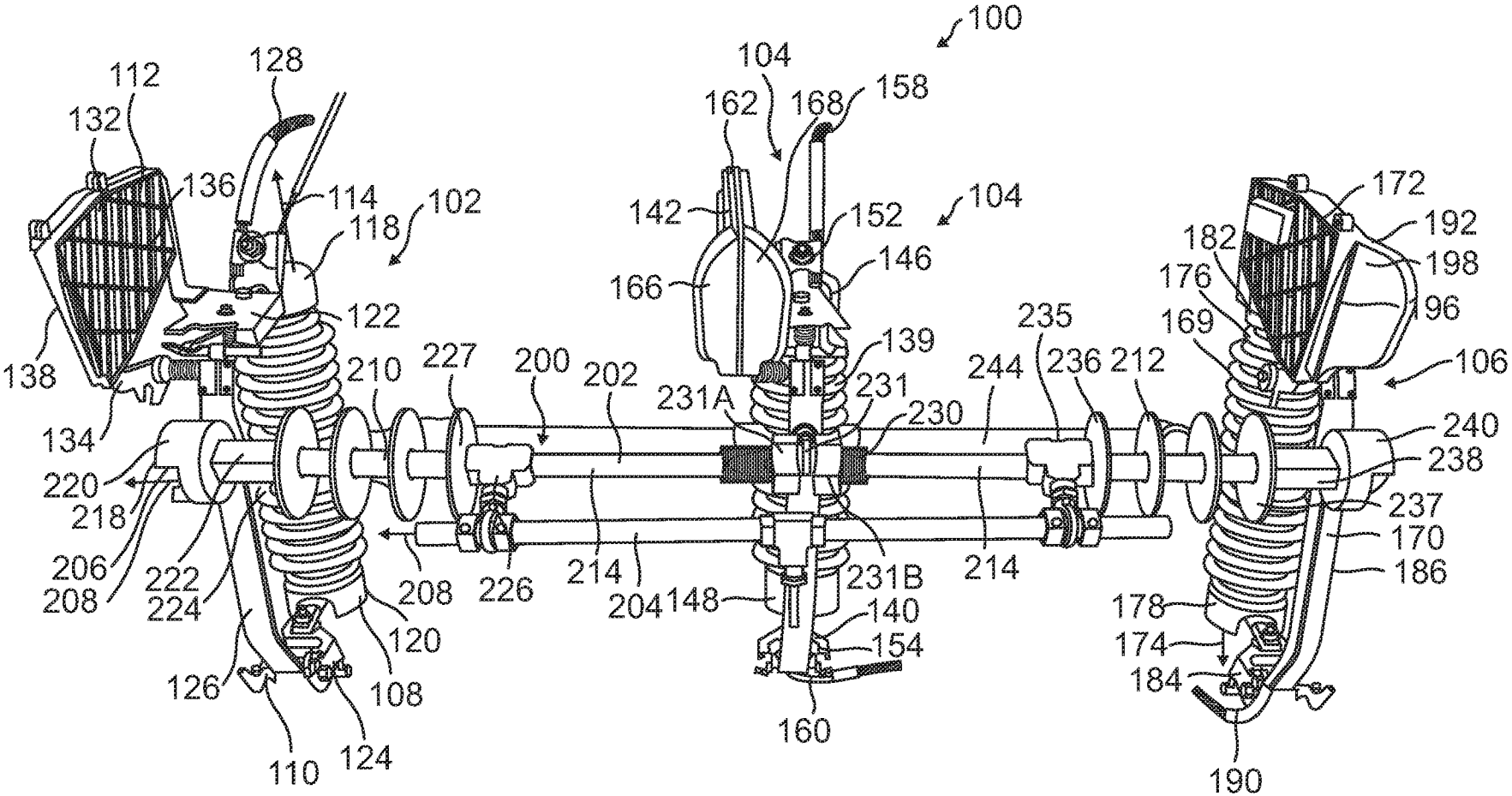
FIG. 1 illustrates one embodiment of a 3-phase power isolation switch device when the 3-phase power isolation switch device is closed.
Figure 2:
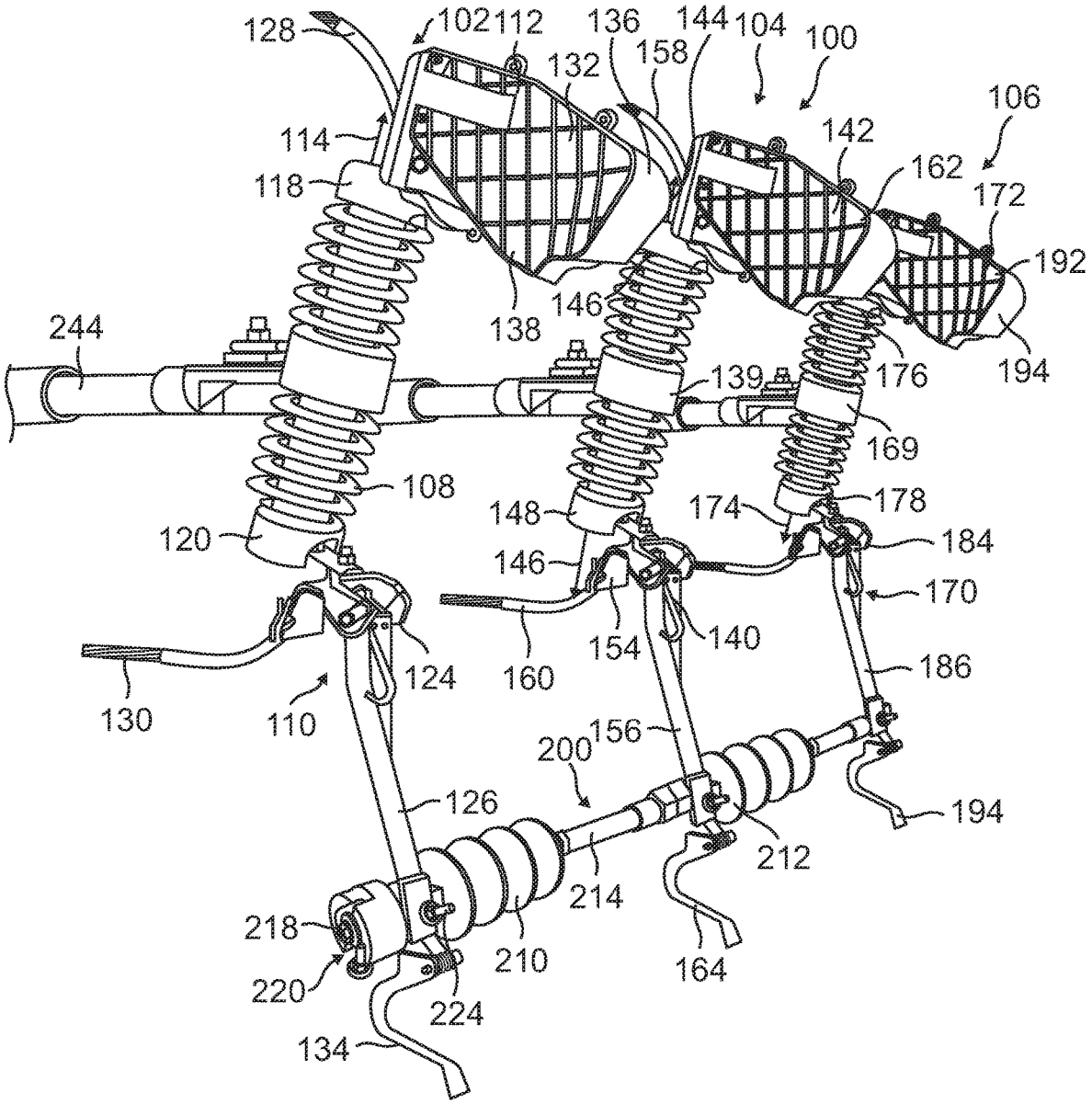
FIG. 2 illustrates the 3-phase power isolation switch device shown in FIG. 1 when the 3-phase power isolation switch device is open.

Referring now to FIG. 1 and FIG. 2, FIG. 1 illustrates one embodiment of a 3-phase power isolation switch device 100 in accordance with this disclosure when the 3-phase power isolation switch device 100 is closed and FIG. 2 illustrates the 3-phase power isolation switch device 100 shown in FIG. 1 when the 3-phase power isolation switch device 100 is open. The 3-phase power isolation switch device 100 includes a power isolation switch device 102, 104, 106 for each of the three phases of a power utility lines. In this manner, all three phases of the power utility lines can be switched off and on using the 3-phase power isolation switch device 100.

With regard to the power isolation switch device 102 for a first phase of the 3-phase power isolation switch device 100, the power isolation switch device 102 includes a power insulator 108, a switch 110, and an arc breaker 112. In this embodiment, the power insulator 108 is a polymer insulator and/or a porcelain insulator. Furthermore, in this embodiment, the power insulator 108 is formed as a series of flat disks connected by a rod. This is typical of power utility lines although other embodiments of the power insulator may be utilized. This embodiment of the power insulator 108 is rated at 15 kV. However, other implementations may have different voltage ratings depending on the power insulation that is needed. The illustrated power insulator 108 is formed so as to have an axis of symmetry 114. When the 3-phase power isolation switch device 100 is mounted on a power pole (not explicitly shown), the axis of symmetry 114 of the power insulator 108 will point in the up and down vertical directions and thus define a top end 118 and a bottom end 120. The arrangement which is discussed above allows for the axis of symmetry 114 to be oriented vertically instead of horizontally and thus the power isolation switch device 102 does not require two power insulators.

The power insulator 108 and the switch 110 are connected in parallel. The switch 110 is configured to be opened and closed. Thus, when the switch 110 is closed, the switch 110 provides a path for current to bypass the power isolator 108. More specifically, the switch 110 includes a terminal 122, a terminal 124, and a conductive member 126. In this particular embodiment, the conductive member 126 is provided as a solid blade disconnect. The conductive member 126 is connected to the terminal 124 and is also swingably attached to the terminal 124. In this manner, the conductive member 126 is configured to connect to the terminal 122 in the closed position and so as to be disconnected from the terminal 122 in an open position. Once the switch 110 is opened when the conductive member 126 is provided in the open position, the power insulator 108 prevents current from passing between the terminal 122 and the terminal 124. Note that attached to each of the terminals 122, 124 one of two wire leads 128, 130. Each of the wire leads 128, 130 (or the terminals 122, 124 themselves) can be attached to the section of the one-phase utility line that is to be neutralized by the power isolation switch device 102. In other words, by closing and opening the power isolation switch device 102, the section of one-phase utility line that is attached between the wire leads 128, 130 can be activated and deactivated.

To prevent electric arcs from occurring when the switch 110 is being opened, the power isolation switch device 102 includes the arc breaker 112. The arc breaker 112 includes an arc chute 132 and an arc contact 134. The arc contact 134 is operably associated with the switch 110 such that the arc contact 134 is removed from the arc chute 132 as the switch 110 is opened and is inserted to contact the arc chute 132 when the switch 110 is closed.

In this example, the arc contact 134 is an arcuate conductive arc blade and the arc chute 132 is connected to the terminal 122 (the terminal 122 is disconnected and connected to the conductive member 126 in order to open and close the switch 110). The arc chute 132 has a pair of chute walls 136, 138 that are separated so as to receive the arc contact 134 when the arc contact 134 makes contact with the arc chute 132. In this embodiment, the arc contact 134 is operably associated with the conductive member 126 such that the arc contact 134 is inserted into the arc chute 132 when the conductive member 126 is in the closed position and is removed from the arc chute 132 when the conductive member 126 is in the open position. At the moment that the arc contact 134 is separated from the terminal 122, current can flow into the arc chute 132 and electromagnetic energy can be dissipated by the arc chute 132 thereby preventing an electric arc. As explained in further detail below, the arc contact 134 remains in contact between the chute walls 136, 138 until the conductive member 126 is swung out of the closed position by a minimum angle. This allows the current to be discharged through the arc chute 132 for long enough to prevent an electric arc. After the conductive member 126 has been swung past the minimum angle, the arc contact 134 is pulled out of the arc chute 132 as the conductive member 126 is swung to the open position shown in FIG. 2.

With regard to the power isolation switch device 104 for a second phase of the 3-phase power isolation switch device 100, the power isolation switch device 102 includes a power insulator 139, a switch 140, and an arc breaker 142. In this embodiment, the power insulator 139 is a polymer insulator and/or a porcelain insulator. Furthermore, in this embodiment, the power insulator 139 is formed as a series of flat disks connected by a rod. This is typical of power systems although other embodiments of the power insulator may be utilized. This embodiment of the power insulator 139 is rated at 15 kV. However, other implementations may have different voltage ratings depending on the power insulation that is needed. The illustrated power insulator 139 is formed so as to have an axis of symmetry 144. When the 3-phase power isolation switch device 100 is mounted on the power pole (not explicitly shown), the axis of symmetry 144 of the power insulator 139 will point in the up and down vertical directions and thus define a top end 146 and a bottom end 148. The arrangement which is discussed above allows for the axis of symmetry 144 to be oriented vertically instead of horizontally and thus the power isolation switch device 104 does not require two power insulators.

The power insulator 139 and the switch 140 are connected in parallel. The switch 140 is configured to be opened and closed. Thus, when the switch 140 is closed, the switch 140 provides a path for current to bypass the power isolator 139. More specifically, the switch 140 includes a terminal 152, a terminal 154, and a conductive member 156. In this particular embodiment, the conductive member 156 is provided as a solid blade disconnect. The conductive member 156 is connected to the terminal 154 and is also swingably attached to the terminal 154. In this manner, the conductive member 156 is configured to connect to the terminal 152 in the closed position and so as to be disconnected from the terminal 152 in an open position. Once the switch 140 is opened when the conductive member 156 is provided in the open position, the power insulator 139 prevents current from passing between the terminal 152 and the terminal 154. Note that attached to each of the terminals 152, 154 one of two wire leads 158, 160. Each of the wire leads 158, 160 (or the terminals 152, 154 themselves) can be attached to the section of the one-phase utility power line that is to be neutralized by the power isolation switch device 104. In other words, by closing and opening the power isolation switch device 104, the section of one-phase utility line that is attached between the wire leads 158, 160 can be activated and deactivated.

To prevent electric arcs from occurring when the switch 140 is being opened, the power isolation switch device 104 includes the arc breaker 142. The arc breaker 142 includes an arc chute 162 and an arc contact 164. The arc contact 164 is operably associated with the switch 140 such that the arc contact 164 is removed from the arc chute 162 as the switch 140 is opened and is inserted to contact the arc chute 162 when the switch 140 is closed.

In this example, the arc contact 164 is an arcuate conductive arc blade and the arc chute 162 is connected to the terminal 152 (the terminal 152 is disconnected and connected to the conductive member 156 in order to open and close the switch 140). The arc chute 162 has a pair of chute walls 166, 168 that are separated so as to receive the arc contact 164 when the arc contact 164 makes contact with the arc chute 162. In this embodiment, the arc contact 164 is operably associated with the conductive member 156 such that the arc contact 164 is inserted into the arc chute 162 when the conductive member 156 is in the closed position and is removed from the arc chute 162 when the conductive member 156 is in the open position. At the moment that the arc contact 164 is separated from the terminal 152, current can flow into the arc chute 162 and electromagnetic energy can be dissipated by the arc chute 162 thereby preventing an electric arc. As explained in further detail below, the arc contact 164 remains in contact between the chute walls 166, 168 until the conductive member 156 is swung out of the closed position by a minimum angle. This allows the current to be discharged through the arc chute 162 for long enough to prevent an electric arc. After the conductive member 156 has been swung past the minimum angle, the arc contact 164 is pulled out of the arc chute 162 as the conductive member 156 is swung to the open position shown in FIG. 2.

With regard to the power isolation switch device 106 for a third phase of the 3-phase power isolation switch device 100, the power isolation switch device 102 includes a power insulator 169, a switch 170, and an arc breaker 172. In this embodiment, the power insulator 169 is a polymer insulator and/or a porcelain insulator. Furthermore, in this embodiment, the power insulator 169 is formed as a series of flat disks connected by a rod. This is typical of power systems although other embodiments of the power insulator may be utilized. This embodiment of the power insulator 169 is rated at 15 kV. However, other implementations may have different voltage ratings depending on the power insulation that is needed. The illustrated power insulator 169 is formed so as to have an axis of symmetry 174. When the 3-phase power isolation switch device 100 is mounted on the power pole (not explicitly shown), the axis of symmetry 174 of the power insulator 169 will point in the up and down vertical directions and thus define a top end 176 and a bottom end 178. The arrangement which is discussed above allows for the axis of symmetry 174 to be oriented vertically instead of horizontally and thus the power isolation switch device 106 does not require two power insulators.

The power insulator 169 and the switch 170 are connected in parallel. The switch 170 is configured to be opened and closed. Thus, when the switch 170 is closed, the switch 170 provides a path for current to bypass the power isolator 169. More specifically, the switch 170 includes a terminal 182, a terminal 184, and a conductive member 186. In this particular embodiment, the conductive member 186 is provided as a solid blade disconnect. The conductive member 186 is connected to the terminal 184 and is also swingably attached to the terminal 184. In this manner, the conductive member 186 is configured to connect to the terminal 182 in the closed position and so as to be disconnected from the terminal 182 in an open position. Once the switch 170 is opened when the conductive member 186 is provided in the open position, the power insulator 169 prevents current from passing between the terminal 182 and the terminal 184. Note that attached to each of the terminals 182, 184 one of two wire leads 188 (not explicitly shown), 190. Each of the wire leads 188, 190 (or the terminals 182, 184 themselves) can be attached to the section of the one-phase utility line that is to be neutralized by the power isolation switch device 106. In other words, by closing and opening the power isolation switch device 106, the section of one-phase utility line that is attached between the wire leads 188, 190 can be activated and deactivated.

To prevent electric arcs from occurring when the switch 170 is being opened, the power isolation switch device 106 includes the arc breaker 172. The arc breaker 172 includes an arc chute 192 and an arc contact 194. The arc contact 194 is operably associated with the switch 170 such that the arc contact 194 is removed from the arc chute 192 as the switch 170 is opened and is inserted to contact the arc chute 192 when the switch 170 is closed.

In this example, the arc contact 194 is an arcuate conductive arc blade and the arc chute 192 is connected to the terminal 182 (the terminal 182 is disconnected and connected to the conductive member 186 in order to open and close the switch 170). The arc chute 192 has a pair of chute walls 196, 198 that are separated so as to receive the arc contact 194 when the arc contact 194 makes contact with the arc chute 192. In this embodiment, the arc contact 194 is operably associated with the conductive member 186 such that the arc contact 194 is inserted into the arc chute 192 when the conductive member 186 is in the closed position and is removed from the arc chute 192 when the conductive member 186 is in the open position. At the moment that the arc contact 194 is separated from the terminal 182, current can flow into the arc chute 192 and electromagnetic energy can be dissipated by the arc chute 192 thereby preventing an electric arc. As explained in further detail below, the arc contact 194 remains in contact between the chute walls 196, 198 until the conductive member 186 is swung out of the closed position by a minimum angle. This allows the current to be discharged through the arc chute 192 for long enough to prevent an electric arc. After the conductive member 186 has been swung past the minimum angle, the arc contact 194 is pulled out of the arc chute 192 as the conductive member 194 is swung to the open position shown in FIG. 2.

As shown in FIG. 1 and in FIG. 2, the 3-phase power isolation switch device 100 includes a movable handle 200. The movable handle 200 includes a tie bar 202 and a grip 204. Both the tie bar 202 and the grip 204. The tie bar 202 of the movable handle 200 is attached to each of the conductive members 126, 156, 186 of the switches 110, 140, 170. The tie bar 202 and the grip 204 both have axis of symmetry 206, 208 that are provided along the length of the tie bar 202 and the grip 204. Note that the axis of symmetry 206 are substantially orthogonal to the axis of symmetry 114, 144, 174 of the power insulators 108, 139, 169. In this manner, the tie bar 202 and the grip 204 can extend so as to swing each of the conductive members 126, 156, 186 simultaneously.

More specifically, a hot stick (not explicitly shown) can be utilized on the grip 204, which is attached to the tie bar 202. Since the tie bar 202 is attached to each of the conductive members 126, 156, 186, the conductive member 126, the conductive member 156, and the conductive member 186 are opened and closed simultaneously by moving the movable handle 200. In this manner, the movable handle 200 is also configured to remove and insert each of the arc contacts 134, 164, 194 into their respective arc chutes 132, 162, 192 simultaneously since the conductive members 126, 156, 186 are attached to the arc contacts 134, 164, 194. Accordingly, the movable handle 200 allows for each phase of the 3-phase power isolation device 100 to be operated simultaneously.

In addition, the tie bar 202 is configured to isolate each of the phases so that the handle 200 does not cause a short. More specifically, the tie bar 202 includes a power insulator 210 and a power insulator 212. The power insulator 210 is connected between the conductive member 126 and the conductive member 156. In this embodiment, an epoxy rod 214 is provided that slides through all of the elements of the tie bar 202. The epoxy rod 214 is provided so as to have a section that provides length between the power insulator 210 and the attachment location to the conductive member 156 of the tie bar 202. As such, the first phase and the second phase are isolated by the tie bar 202 of the handle 200.

Furthermore, the power insulator 212 is connected between the conductive member 156 and the conductive member 186. The epoxy rod 214 has a section that provides length between the power insulator 212 and the attachment location to the conductive member 156 of the tie bar 202. As such, the second phase and the third phase are isolated by the tie bar 202 of the handle 200. The grip 204 is attached to the tie 202 but not to the switches 110, 140, 170. Accordingly, the tie bar 202 provides the required isolation so as to allow the handle 200 to operate all three phases simultaneously.

Thus, in this embodiment, the 3-phase tie bar 202 comprises two insulators 210, 212 and two insulated epoxy rods (the epoxy rod 214 and the grip 204 which is also an epoxy rod). The insulators 210, 212 are modified polymer insulators that insulate the conductive members 126, 156, 186 from phase-to-phase contact. The epoxy rod 214 and the grip 204 tie the three (3) loads together and serves as a secondary level of insulation from phase-to-phase and/or phase-to-ground contact.

In this embodiment, the tie bar 202 includes a round 218 that attaches to the conductive member 126 to provide an end 220 of the tie bar 202. A rod 222 is then attached to the round 218. The rod 222 is then attached to an end 224 of the power insulator 210. A tee connector 226 is then attached to the oppositely disposed end 227 of the power insulator 210. The tee connector 226 is further attached to the epoxy rod 214. The epoxy rod 214 is inserted through a machined brass round 230. The machine brass round 230 is inserted through an eyebolt 232. The epoxy rod 214 is inserted through the machines brass round 230 and the epoxy rod 214 is then attached to a tee connector 235. The machines brass round 230 is inserted through the eyebolt 231 to provide a tight fit thereby allowing the tie bar 202 to operate on all three conductive members 126, 156, 186. The tee connector 235 is attached to an end 236 of the power insulator 212. An oppositely disposed end 237 of the power insulator 212 is attached to a rod 238 and the rod 238 then attaches to a round 240 at the other end 242 of the tie bar 202. The round 240 is attached to the conductive member 186. The eyebolt 231 is attached to the conductive member 156 while the tee connector 226 and the tee connector 235 are attached near oppositely disposed ends of the grip 204. Two oppositely disposed nuts 231A, 231B are threaded through the machine brass round 230 (which is threaded) until the nuts 231A, 231B are snug against the eyebolt 231.

Note however that the grip 204 and the conductive members 126, 156, 186 are on oppositely disposed sides of the tie bar 202. In this example, the handle 200 is movable since the tie bar 202 is fixed to the conductive members 126, 156, 186, which are swingably attached as discussed above. Other embodiments of the handle 200 may be movably attached using other movement mechanisms that allow for the switches 110, 140, 170 to be opened and closed. Note furthermore that the length of the conductive members 126, 156, 186 is parallel with the axis of symmetry 114, 144, 174 when the conductive members 126, 156, 186 are in the closed position. This allows the handle 200 to operate all three conductive members 126, 156, 186 in the vertical position.

As further shown in FIG. 1 and FIG. 2, the 3-phase power isolation switch device 100 includes a mounting bracket 244 that is attached to the power insulators 108, 139, 169. In this embodiment, the tie bar 202 and the mounting bracket 244 are on opposite sides of the power insulators 108, 139, 169. The mounting bracket 244 is configured to mount the 3-phase power isolation switch device 100 to the power pole (not explicitly shown). The mounting bracket 244 is also constructed from an insulating polymer to protect each of the power isolation switch devices 102, 104, 106 from shorting to ground.

Figure 3:
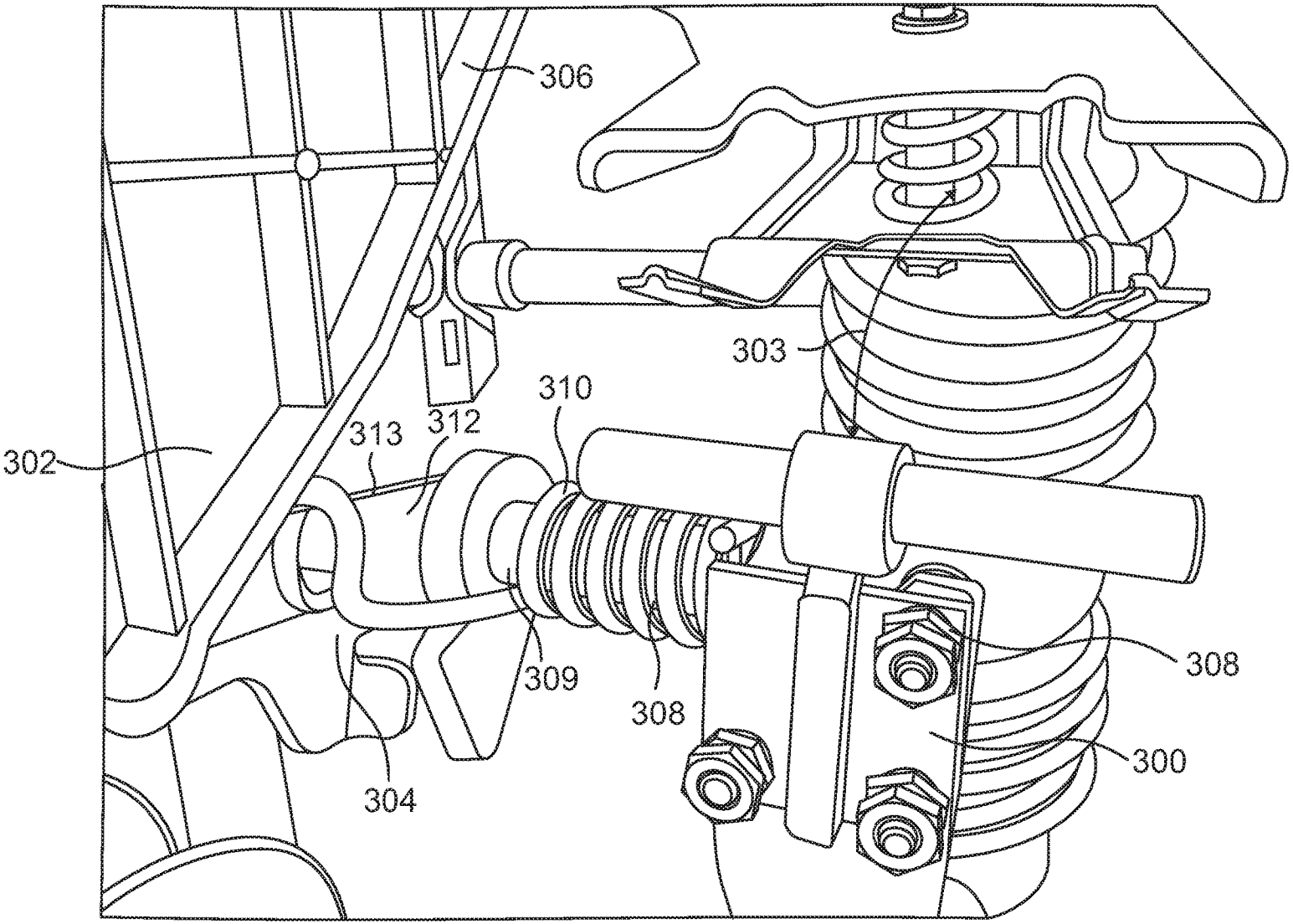
FIG. 3 illustrates a conductive member and an arc breaker, where the conductive member has been swung out of the closed position by a minimum angle prior to an arc contact being removed from an arc chute.
Figure 4:
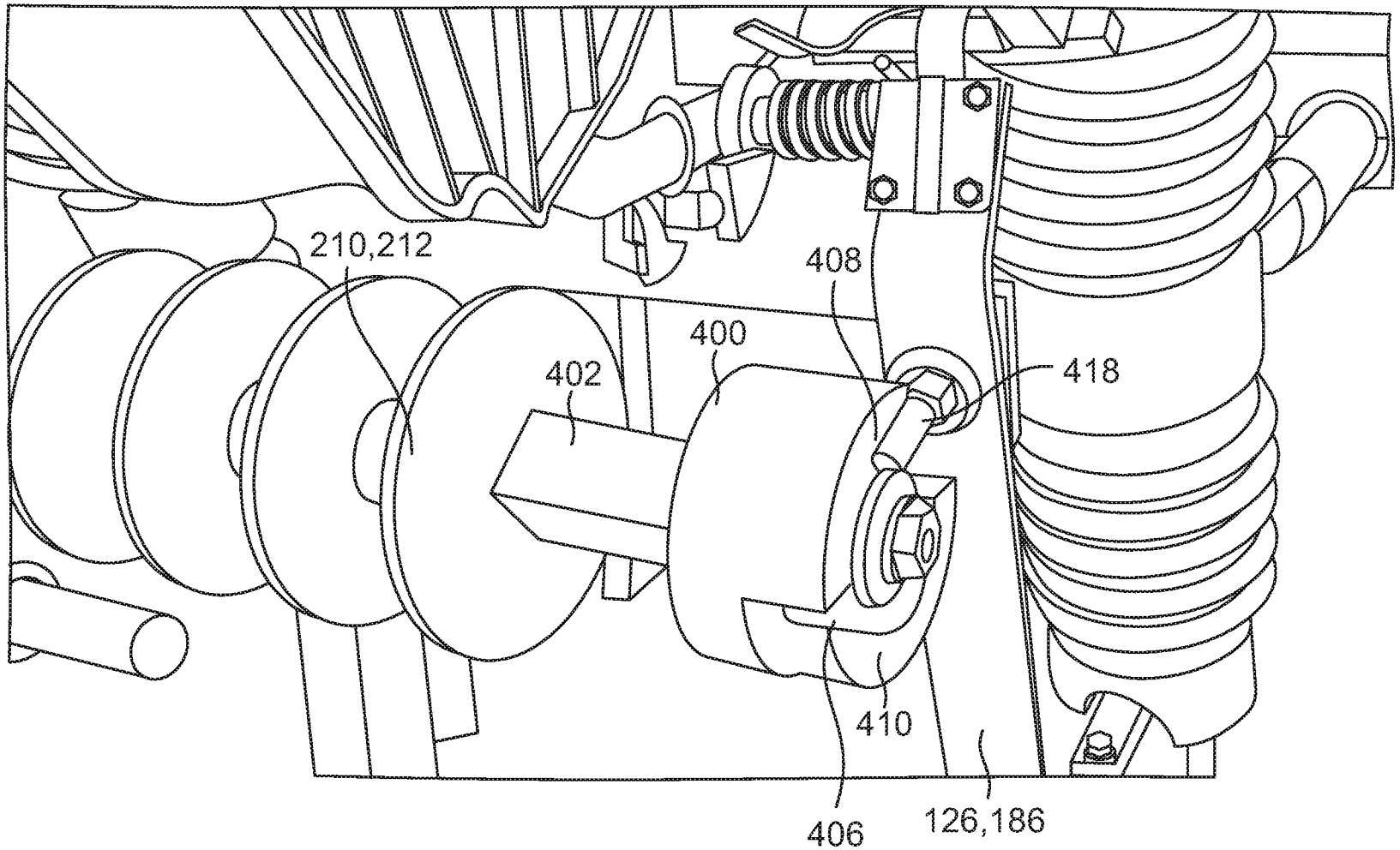
FIG. 4 is an enlarged perspective view of a round on a rod.

Referring now to FIG. 3, FIG. 3 illustrates a conductive member 300 and an arc breaker 302, where the conductive member 300 has been swung out of the closed position by a minimum angle 303 prior to an arc contact 304 being removed from an arc chute 306. More specifically, the arc contact 304 is operably associated with the conductive member 300 such that the arc contact 304 is configured to begin being removed from the arc chute 306 in response to the conductive member 300 being swung out of the closed position by the minimum angle 303. Each of the conductive members 126, 156, 186, arc chutes 132. 162, 192, and arc contacts 134, 164, 194 may be provided as described herein in FIG. 3. In this embodiment, an end 308 of the conductive member 300 is attached to a rod 309. The rod 309 is also swingably attached to an end 312 of the arc contact 304, which in this example is an arcuate conductive blade. Around the rod 308 is a twist spring 310. The twist spring 310 is attached to edge 313 of the arc contact 304.

Prior to the conductive member 300 reaching the minimum angle 303, the arc contact 304 simply swings about the rod 308 and the arc contact 304 remains in the arc chute 306. This increases the tension in the twist spring 310. Once the conductive member 300 reaches the minimum angle 303, the twist spring 310 cannot twist anymore thereby preventing the arc contact 304 from swinging about the rod 308. As such, once the conductive member 300 is swung past the minimum angle 303, the arc contact 304 begins being pulled out of the arc chute 306. This mechanism ensures that the arc contact 304 remains in the arc chute 306 long enough so as to prevent an electric arc once the conductive member 300 becomes disconnected.

Referring now to FIG. 4-FIG. 7, FIG. 4 is an enlarged perspective view of a round 400 on a rod 402. The round 400 is received by and is rigidly affixed to the rod 402. In this regard, the rod 402 has a protrusion 404 (shown on FIG. 7) with a square cross-section, and the round 400 has a square opening 406 (shown on FIG. 6) that receives the outer protrusion of the rod 402. The round 400 further has two ledges 408 and 410 extending from its outer end. The two ledges 408 and 410 are semi-circular and define an opening 412 between the ledges 408 and 410. An eye bolt 414 extends from the solid blade disconnect and is received within the opening 412. Further the rod 402 has a circular protrusion 413 (shown in FIG. 7) that extends through the round 400 and through the opening of the eye bolt 414. A bearing (not shown) inside of the opening of the eye bolt 414 allows the rod 402 to rotate within the eye bolt 414. In this manner, the tie bar 202 rotates with respect to the conductive member 126 or conductive member 186. When the ledges 408 and 410 contact the eye bolt 414, the conductive member 126 or conductive member 186 is open. The ledges 408 and 410 prevent the eye bolt 414 from rotating too far, as further shown with respect to FIG. 5.

Figure 5:
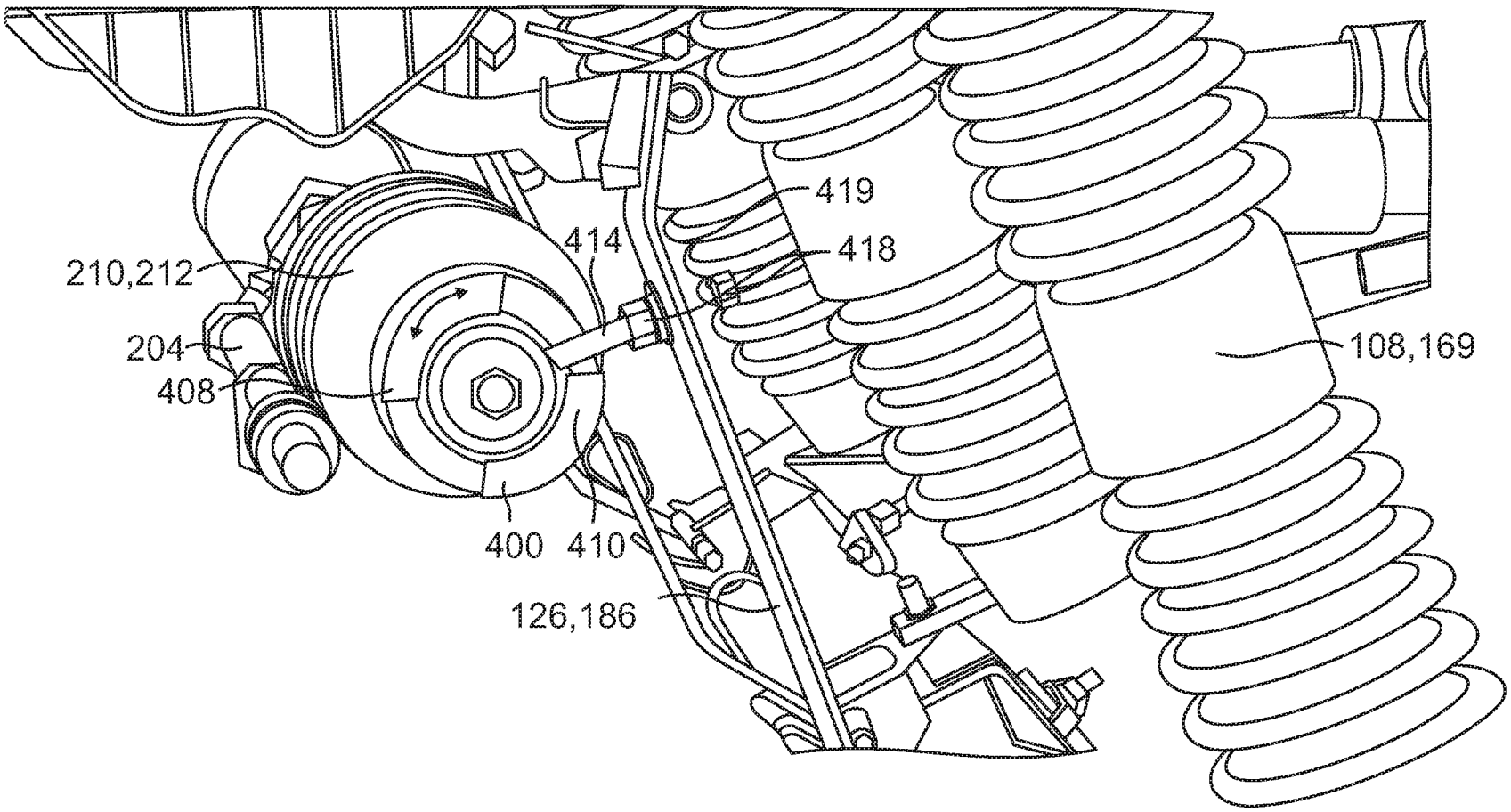
FIG. 5 is an enlarged side view of a round on a rod.

FIG. 5 is a side view of the link arm showing how the eye bolt 414 contacting the ledges 408 and 410 of the round 400 acts as a stop to prevent the switch from further rotation. The eye bolt 414 is rigidly affixed to the conductive member 126 or conductive member 186 via fasteners 418 (nuts and lock washers). The conductive member 126 and conductive member 186 is reinforced by a brass plate 419.

Figure 6:
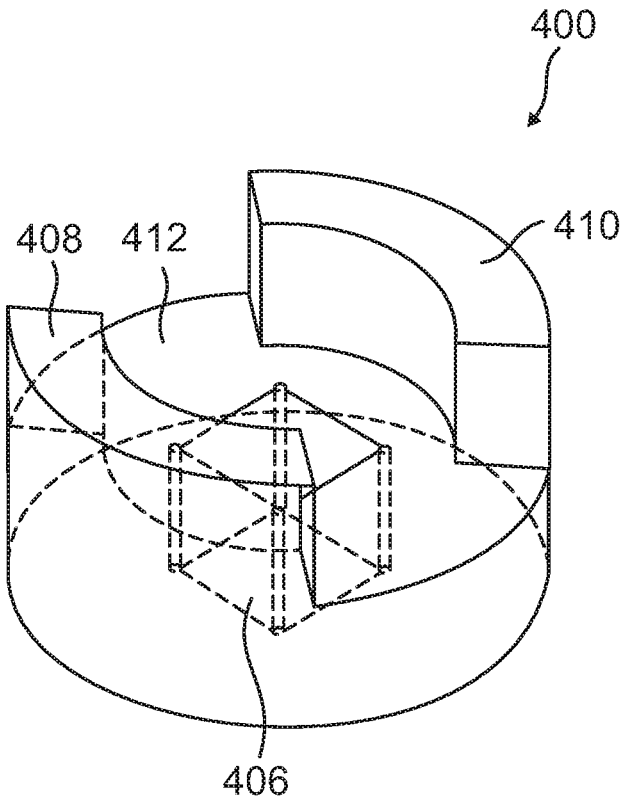
FIG. 6 provides a perspective and transparent view of one embodiment of a round according to an exemplary embodiment of the present disclosure.
Figure 7:
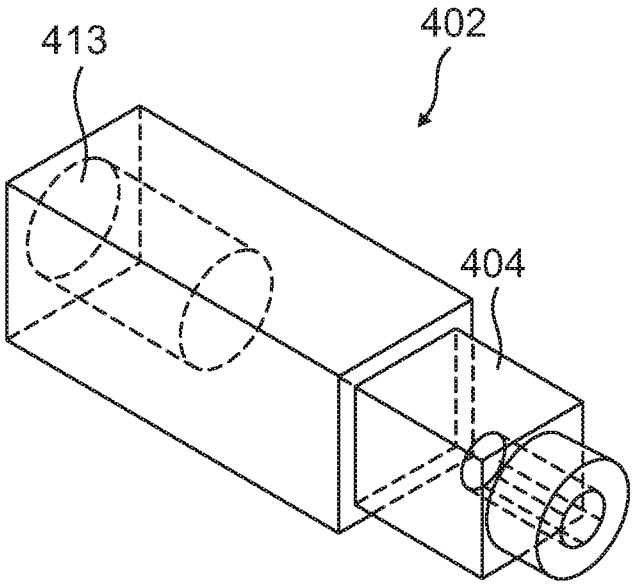
FIG. 7 provides a perspective and transparent view of one embodiment of a rod according to an exemplary embodiment of the present disclosure.

FIG. 6 depicts several views of the round 400 according to an exemplary embodiment of the present disclosure. A rod 402 is disposed inwardly from the round 400. The rod 402 contains a bearing (not shown) and the rod 402 is received by the round 400 to allow the conductive member 126 or conductive member 186 to pivot vertically when opened/ closed. FIG. 5 depicts one embodiment of the brass fittings 416 according to an exemplary embodiment of the present disclosure.

Those skilled in the art will recognize improvements and modification to the preferred embodiments of the present disclosure. All such improvements and modifications are considered within the scope of the concepts disclosed herein and the claims that follow.

What is claimed is:

1. A power isolation switch device, comprising:

a first power insulator;

a first conductive member defining a first end;

a first pair of terminals, the first power insulator connected between the first pair of terminals;

a first conductive member connected to a first one of the first pair of terminals and swingably attached to the first one of the first pair of terminals so as to connect to a second one of the first pair of terminals in a closed position and so as to be disconnected from the second one of the first pair of terminals in an open position;

a first arc chute connected to the second one of the first pair of terminals; and a first arc contact defining a second end that is swingably connected to the first end of the first conductive member, the first arc contact operably associated with the first conductive member such that the first arc contact is inserted into the first arc chute when the first conductive member is in the closed position and is removed from the first arc chute when the first conductive member is in the open position.

2. The power isolation switch device of claim 1, further comprising:

a second power insulator;

a second conductive member;

a second pair of terminals, wherein the second power insulator is connected between the second pair of terminals;

the second conductive member connected to a first one of the second pair of terminals and swingably attached to the first one of the second pair of terminals so as to connect to a second one of the second pair of terminals in a closed position and so as to be disconnected from the second one of the second pair of terminals in an open position;

a second arc chute connected to the second one of the second pair of terminals; and a second arc contact operably associated with the second conductive member such that the second arc contact is inserted into the second arc chute when the second conductive member is in the closed position and is removed from the second arc chute when the second conductive member is in the open position.

3. The power isolation switch device of claim 2, further comprising a movable handle attached to the first conductive member and the second conductive member such that the first conductive member and the second conductive member are opened and closed simultaneously by moving the movable handle.

4. The power isolation switch device of claim 3, wherein the movable handle comprises a third power insulator between the first conductive member and the second conductive member.

5. The power isolation switch device of claim 4, further comprising:

a third power insulator;

a third conductive member;

a third pair of terminals, wherein the third power insulator is connected between the third pair of terminals;

the third conductive member connected to a first one of the third pair of terminals and swingably attached to the first one of the third pair of terminals so as to connect to a second one of the third pair of terminals in a closed position and so as to be disconnected from the second one of the third pair of terminals in an open position;

a third arc chute connected to the second one of the third pair of terminals; and a third arc contact operably associated with the third conductive member such that the third arc contact is inserted into the third arc chute when the third conductive member is in the closed position and is removed from the third arc chute when the third conductive member is in the open position.

6. The power isolation switch device of claim 5, further comprising a movable handle attached to the first conductive member, the second conductive member, and the third conductive member such that the first conductive member, the second conductive member, and the third conductive member are opened and closed simultaneously by moving the movable handle.

7. The power isolation switch device of claim 6, wherein the movable handle comprises a fourth power insulator between the first conductive member and the second conductive member and a fifth power insulator between the second conductive member and the third conductive member.

8. The power isolation switch device of claim 1, further comprising a mounting bracket configured so as to mount the power isolation switch device on a power pole.

* * * * *